US009500456B2

(12) United States Patent
Pfiffer et al.

(10) Patent No.: US 9,500,456 B2
(45) Date of Patent: Nov. 22, 2016

(54) COMBINED STEERING AND DRAG-REDUCTION DEVICE

(71) Applicants: ROXEL FRANCE, St Medard en Jalles (FR); HERAKLES, Le Haillan (FR)

(72) Inventors: Andre Pfiffer, Saint-Medard-en-Jalles (FR); Pascal Caubet, Le Haillan (FR); Jean-Michel Larrieu, Le Haillan (FR)

(73) Assignees: ROXEL FRANCE, Saint-Médard-en-Jalles (FR); HERAKLES, Le Haillan (FR)

( * ) Notice: Subject to any disclaimer, the term of this patent is extended or adjusted under 35 U.S.C. 154(b) by 0 days.

(21) Appl. No.: 14/437,486

(22) PCT Filed: Oct. 21, 2013

(86) PCT No.: PCT/EP2013/071990

§ 371 (c)(1),
(2) Date: Apr. 21, 2015

(87) PCT Pub. No.: WO2014/064055

PCT Pub. Date: May 1, 2014

(65) Prior Publication Data

US 2015/0276362 A1 Oct. 1, 2015

(30) Foreign Application Priority Data

Oct. 22, 2012 (FR) ..... 12 60044

(51) Int. Cl.
*F42B 10/66* (2006.01)
*F42B 15/01* (2006.01)
(Continued)

(52) U.S. Cl.
CPC ..... *F42B 15/01* (2013.01); *F42B 10/40* (2013.01); *F42B 10/663* (2013.01)

(58) Field of Classification Search
CPC ..... F42B 10/32; F42B 10/38; F42B 10/40; F42B 10/60; F42B 10/66; F42B 10/661; F42B 10/663; F42B 10/665; F42B 10/666; F42B 10/668; F42B 15/01; B64C 23/06; F02K 9/80; F02K 9/805
USPC ..... 244/3.1–3.23
See application file for complete search history.

(56) References Cited

U.S. PATENT DOCUMENTS 3,325,121 A * 6/1967 Banaszak ..... B64C 23/06 244/3.22
5,004,184 A * 4/1991 Bernard ..... F42B 10/666 244/3.22

(Continued)

FOREIGN PATENT DOCUMENTS

FR 2570447 A1 * 3/1986
FR 2997179 A1 * 4/2014 ..... F42B 15/01

(Continued)

*Primary Examiner* — Bernarr Gregory
(74) *Attorney, Agent, or Firm* — Baker & Hostetler LLP

(57) ABSTRACT

A combined steering and drag reduction device for a missile is disclosed. The device includes a base and an upper part which are arranged in succession along a main axis of navigation of the missile. Advantageously, the device also includes a pressurized-gas generator and at least one lateral thruster having at least one nozzle configured to deliver a thrust, by expanding gas transmitted by the generator and oriented along an axis substantially perpendicular to the main axis. The at least one lateral thruster also has at least one stabilizing chamber configured to expand the gas transmitted by the generator and expel it through an outlet section of the base substantially perpendicular to the main axis.

15 Claims, 4 Drawing Sheets

(51) Int. Cl.

| | |
|---|---|
| ***F42B 10/40*** | (2006.01) |
| *F42B 10/00* | (2006.01) |
| *F42B 15/00* | (2006.01) |

(56) References Cited

U.S. PATENT DOCUMENTS 5,158,246 A 10/1992 Anderson, Jr.
5,456,425 A * 10/1995 Morris ..... F02K 9/805 244/3.22
7,102,113 B2 * 9/2006 Fujita ..... F42B 10/663 244/3.1
2004/0245371 A1 12/2004 Fujita et al.

FOREIGN PATENT DOCUMENTS

GB 2086548 A 5/1982
WO WO86/05581 A1 * 9/1986

* cited by examiner

COMBINED STEERING AND DRAG-REDUCTION DEVICE

CROSS-REFERENCE TO RELATED APPLICATIONS

This application is a National Stage of International Patent Application PCT/EP2013/071990, filed on Oct. 21, 2013, which claims priority to French Patent Application No. FR 1260044, filed on Oct. 22, 2012, the disclosures of which are incorporated by reference in their entirety.

FIELD OF THE INVENTION

The present invention relates to the field of solid-charge rocket motors and steering control systems for missiles. More specifically it relates to a combined device for reducing drag and controlling the trajectory using lateral thrusters. This device can be applied to all missile main propulsion technologies such as solid, liquid or hybrid propulsion.

BACKGROUND

One current missile design comprises a body that is generally cylindrical about a main axis of navigation and inside which a solid charge rocket motor is placed. It also comprises a set of wings or aerodynamic control surfaces fixed notably to a rear part of the body of the missile. This set of wings, of which there are, for example, four and which are distributed uniformly about the circular perimeter of the body both improves the lift of the missile in flight and allows the missile to be steered about its three axes: pitch, yaw and roll by altering the orientation of wing portions. In order to improve missile performance, particularly their agility at low or medium speed, various devices combined under the heading of TVC (which stands for Thruster Vector Control) are known. Thus, divergent nozzles capable of moving or provided with jet deflectors allow the flight trajectory to be controlled by altering the orientation of the thrust generated in the divergent nozzle of the rocket motor. In order further to improve the steering of a missile, particularly when it is intended for short-range missions, recourse is also had to devices commonly referred to as lateral thrusters. In these devices, one or more lateral thrusts, generated by the combustion of a secondary solid charge, allows the trajectory to be altered about the three axes of navigation, pitch, yaw and roll. Maximum effectiveness of such a device having lateral thrusters is obtained during the acceleration phase of the rocket motor, the effectiveness of the aerodynamic control surfaces still being limited in this acceleration phase. It becomes possible in this phase to steer the missile on trajectories having very small radius of curvature.

The range of the missile is another traditional limitation. In order to increase the range of the missile for a given mass of solid charge, attempts are made for example to reduce the drag or, in other words, to limit the losses generated by aerodynamic turbulence and particularly turbulence in the wake of the missile in flight. Through the shape of the wings, the design of the afterbody or other components of the missile, it is possible to limit these losses and increase the range of the rocket motor.

Thus, for short-range missiles the desire is to achieve better steerability; for long-range missions reductions in the coefficient of drag are expected. The existing dedicated systems do not provide an effective solution to these two problems. The rocket motors therefore have to be typed according to their use. With a view to unifying weapon systems and thus limiting the number and mass of equipment to be carried on board the transport or launch vehicle, it is desirable to have available a system that allows both better steerability for short-range missions, and a reduction in the coefficient of drag for long-range missions.

A solution both to the need for modularity of missions, notably a capability to achieve the desired performance whatever the desired altitude and range, and to the need to adapt the missile to suit the highest number of firing platforms, is therefore sought.

SUMMARY OF THE INVENTION

To this end, one subject of the invention is a combined steering and drag reduction device intended for a missile comprising a base and an upper part which are arranged in succession along a main axis of navigation of the missile. The device comprises a pressurized-gas generator. Use of a gas generator based on solid, liquid or hybrid propellant is notably contemplated. The device also comprises at least one lateral thruster comprising:

at least one nozzle, configured to deliver a thrust, by expanding gas transmitted by the generator and oriented along an axis substantially perpendicular to the main axis, at least one stabilizing chamber configured to expand the gas transmitted by the generator and expel it through an outlet section of the base substantially perpendicular to the main axis.

According to one embodiment of the present invention, at least one lateral thruster comprises a directional-control device allowing selection of one of the nozzles or one of the stabilizing chambers of the lateral thruster and allowing pressurized gas from the generator to be transmitted toward the selected nozzle or the selected stabilizing chamber.

In one particularly advantageous embodiment of the present invention, the device comprises four lateral thrusters on the base of the missile at the four respective corners of a square contained in a plane substantially perpendicular to the main axis and centered on the main axis. Each of the lateral thrusters comprises two nozzles the respective thrusts of which are oriented along an axis perpendicular to an axis contained in said plane and passing through the main axis and in a direction one away from the other, the device thus configured being able to control the trajectory of the missile in three directions in space.

In one possible embodiment of the invention, the combined steering and drag reduction device takes the form of a modular kit independent of the design of the missile and of the main propulsion device thereof, that the user can choose to attach to the missile for the purposes of performance associated with the contemplated mission profile. In other words, the combined steering and drag reduction device comprises removable fixing means which are intended to fix it to the base of a missile.

The invention also relates to a missile comprising a combined steering and drag reduction device having the features described hereinabove and the maximum effectiveness of which will be achieved at the end of operation of the main propulsion device.

BRIEF DESCRIPTION OF THE DRAWINGS

The invention will be better understood and further advantages will become apparent from reading the detailed description of some embodiments given by way of example in the following figures.

For the sake of clarity, in the various figures the same elements will bear the same references.

DETAILED DESCRIPTION

Figure 1B:
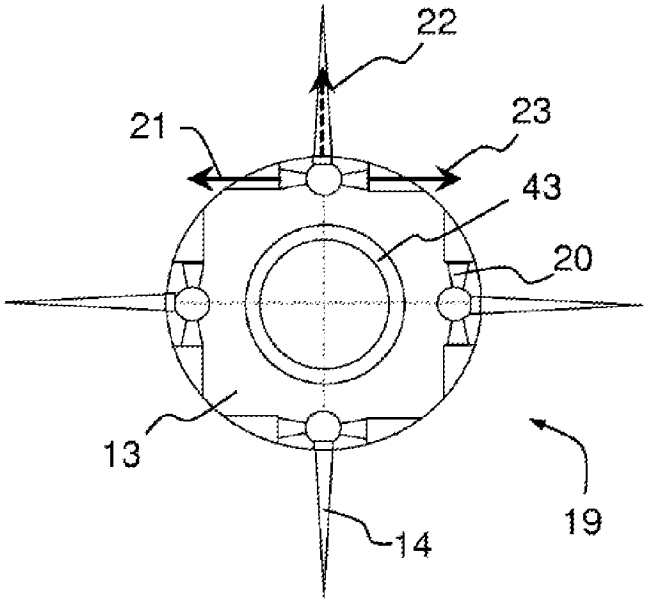
FIGS. 1*a* and 1*b* depict a missile equipped with a combined steering and drag reduction device according to one embodiment of the invention.
Figure 1A:
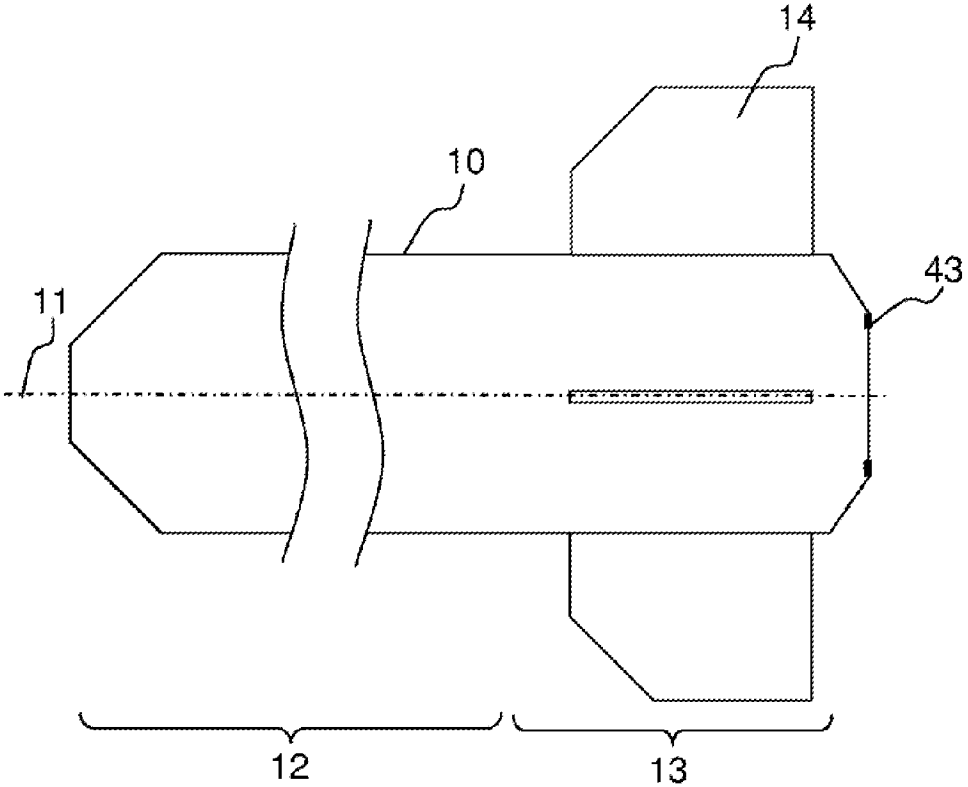

FIGS. 1*a* and 1*b* depict a missile equipped with a combined steering and drag reduction device according to the invention. According to a current design, the missile depicted in FIG. 1 comprises a body 10 that is substantially cylindrical about a main axis 11 of navigation of the missile. The missile comprises an upper part 12 and a base 13 which are arranged in succession along the main axis.

The missile also comprises a set of wings 14 fixed to the body 10 of the missile. These wings 14, of which there are four in FIGS. 1*a* and 1*b*, are distributed uniformly about the circular perimeter of the body 10 and are configured according to known techniques in order to improve the lift of the missile in flight and control the trajectory of the missile in flight. By altering the orientation of one or more wings, or wing portions, it is possible to control the trajectory about the axes of pitch, yaw and roll; in the embodiment depicted in FIGS. 1*a* and 1*b* the axis of roll coincides with the main axis 11.

FIG. 1*b* depicts a combined steering and drag reduction device 19 according to one embodiment of the invention. The device 19 comprises four lateral thrusters 20 arranged on the base 13 of the missile. Each of the lateral thrusters 20 is arranged in the continuation of one of the wings 14, at the respective four corners of a square contained in a plane substantially perpendicular to the main axis of navigation 11 and centered on the main axis 11. What is meant by substantially perpendicular to the main axis 11 is any plane that makes an angle of less than 10° with the axis strictly perpendicular to the main axis 11. Each of the lateral thrusters is able to deliver a thrust along several axes substantially contained in a plane perpendicular to the main axis. As we shall detail later on, the thrust delivered by the lateral thrusters is preferably generated by the expansion of a pressurized gas, for example derived from the combustion of a solid, liquid or hybrid propellant.

The lateral thrusters 20 thus comprise at least two nozzles of which the respective thrusts 21 and 22 are oriented in directions away from one another, the axes of thrust of the two nozzles being substantially perpendicular to an axis connecting the lateral thruster to the center of the circular perimeter of the base 13. What is meant by substantially perpendicular to the axis connecting the lateral thruster to the center of the circular perimeter of the base 13 is any axis making an angle of less than 10° with the axis strictly perpendicular to the axis connecting the lateral thruster to the center of the circular perimeter of the base 13.

The lateral thrusters 20 also comprise a load-shedding orifice delivering a thrust 22 oriented toward the outside of the missile and along the axis connecting the lateral thruster to the center of the circular perimeter of the base 13.

As we shall detail later on, each of the lateral thrusters further comprises a directional-control device making it possible to control the orientation of the thrust delivered, by selecting one of the nozzles or the load-shedding orifice.

Figure 2A:
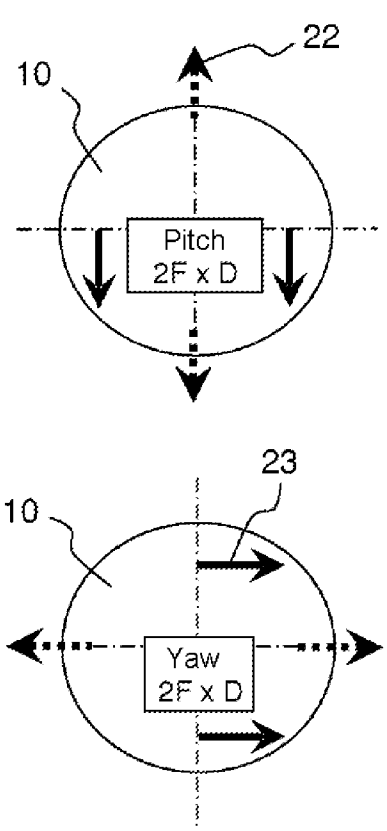
FIGS. 2*a*, 2*b* and 2*c* illustrate the principle of operation of the steering of the trajectory of a missile using a combined device according to the invention.
Figure 2B:
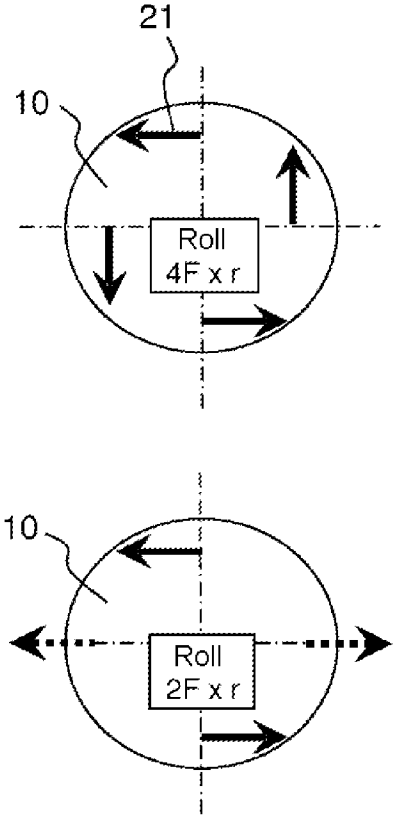
Figure 2C:
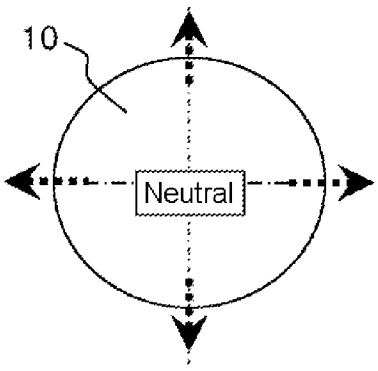

FIGS. 2*a*, 2*b* and 2*c* illustrate the principle of controlling the trajectory of a missile using the device 19 described in FIGS. 1*a* and 1*b*. Through a coordinated control of the orientation of the thrust of the lateral thrusters, the trajectory of the missile about each of the axes of navigation of the missile, pitch, yaw or roll, can be altered. Typically, if the lateral thrusters are considered in a cardinal frame of reference, altering the trajectory about the pitch axis is obtained by orienting the thrusts of the east and west thrusters toward north or toward south simultaneously; the thrusts of the north and south thrusters generated through the load-shedding orifice compensate for one another. By the same principle, altering the trajectory about the yaw axis is obtained by orienting the thrusts of the north and south thrusters toward the east or toward the west simultaneously; the thrusts of the east and west thrusters which are generated through the load-shedding orifice compensate for one another.

For the roll axis, a first solution is to orient the respective thrusts of the north and south thrusters toward the east and toward the west respectively; the thrusts from the east and west thrusters generated through the load-shedding orifice compensate for one another. A second solution is to orient the respective thrusts of the north, east, south and west thrusters toward the west, toward the south, toward the east and toward the north respectively; this second solution generates a couple on the missile that is twice as high as in the first solution.

A neutral position is also possible, as depicted in FIG. 2*c*, by selecting the load-shedding orifice for each of the lateral thrusters.

Thus, the combined device 19 according to the invention allows the trajectory of the missile to be controlled by selecting the orientation of the thrusts from the lateral thrusters. Advantageously, the device comprises an electronic control module configured to control the orientation of the thrusts delivered by each of the lateral thrusters according to a control instruction.

Figure 3:
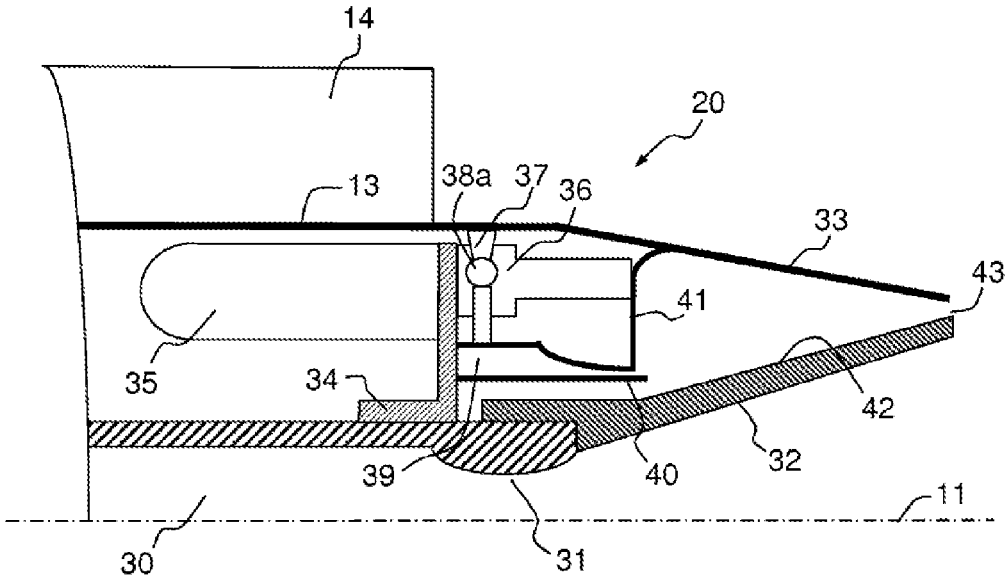
FIG. 3 is a view in cross section of one embodiment of the combined steering and drag reduction device.

FIG. 3 depicts a view in cross section of one embodiment of the combined steering and drag reduction device. FIG. 3 depicts the base 13 and a wing structure 14 of a missile the body of which is cylindrical. The missile is equipped with a solid charge main rocket motor comprising a combustion chamber 30 for a solid charge stored in the body of the missile (the charge is not depicted in the figure). The gases resulting from the combustion pass through a throat 31 then a divergent nozzle 32 that provides the propulsion of the missile through the expansion of the combustion gases. In the embodiment of FIG. 3, the body of the missile at its rear end comprises a base restriction 33 of substantially conical shape. In an alternative embodiment, the body of the missile comprises a base that is cylindrical in the continuation of the body of the missile.

FIG. 3 depicts a lateral thruster 20 of a combined device 19. The combined device according to the invention may comprise one or several lateral thrusters. For preference, it comprises at least four lateral thrusters arranged on the missile as described in the context of FIGS. 1*a* and 1*b*.

The lateral thruster 20 comprises:

- a support 34 providing the connection with a structural part of the missile, the throat of the divergent nozzle in the embodiment depicted in FIG. 3,
- a pressurized-gas generator 35 fixed to the support 34,
- a directional-control device 36 fixed to the support 34, supplied with pressurized gas by the generator 35 and allowing the pressurized gas from the generator to be transmitted toward one of the following components:
  - a load-shedding orifice 37 which allows the pressurized gas to expand, generating a thrust oriented radially toward the outside of the missile as previously described in FIGS. 1*a* and 1*b*,
  - a left-hand lateral nozzle 38*a* and a right-hand lateral nozzle 38*b* (which has not been depicted), allowing the pressurized gas to expand, thereby generating a laterally oriented thrust, as previously described in FIGS. 1*a* and 1*b*,
  - a stabilizing chamber 39 that allows the pressurized gas to expand and be expelled through an outlet section 43 of the base 13 substantially perpendicular to the main axis 11.

The directional-control device 36 has the role of selecting one of these four components and of transmitting the pressurized gas from the generator toward the selected component.

The pressurized-gas generator 35 preferably comprises a charge and an ignition device; the charge, by combustion initiated by the ignition device, allowing the pressurized gas to be generated. The charge of the generator 35 may be of the same type as, or preferably of a different type than, the charge of the main rocket motor. Use of a solid charge such as a solid propellant is envisioned. In one possible embodiment of the invention, the pressurized-gas generator is configured to allow control of repeated ignition and extinguishing of the combustion of the charge. The pressurized-gas generator comprises a propellant the characteristics of which allow a mode of operation of the extinguishable—reignitable type, or reduced consumption type, reducing the combustion pressure by load shedding over several nozzles.

Also envisioned is a pressurized-gas generator comprising a charge of the liquid or hybrid propellant type consisting of a gel or of an oxidizing gas associated with a solid reducing charge.

In one preferred embodiment, the pressurized-gas generator 35 takes a shape that is axisymmetric about the main axis 11, similar to the shape of a torus. The generator can be fixed to the support 34 by various fixing means, several supply ducts are formed to allow sealed transfer of gas from the generator to the directional-control device of each of the lateral thrusters. For preference, the ignition device is positioned near the support 34 and initiates combustion via one end of the solid charge, combustion spreading parallel to the main axis, toward the nose of the missile.

Figure 4:
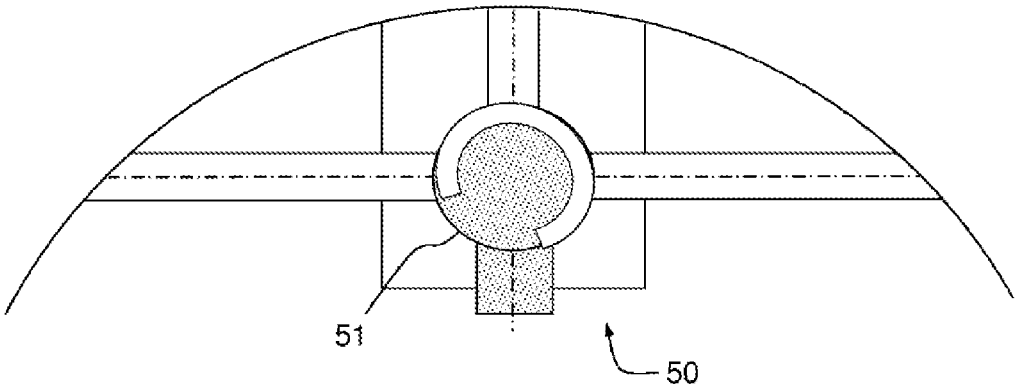
FIG. 4 is one embodiment of a multi-way valve of the plug valve type used in the combined device depicted in FIG. 3.

In one advantageous embodiment of the present invention, the directional-control device 35 is a multi-way valve of the plug valve type, one embodiment of which is depicted in FIG. 4 and described hereinafter. In an alternative embodiment of the present invention, the directional-control device is a needle valve.

For preference, activation of the valve is performed in a proportional mode. An on/off mode can equally be applied. The valve comprises electromechanical or electropneumatic operating means.

In the favored case of the invention whereby there are several lateral thrusters, the valves of the directional-control devices of each of the thrusters comprise identical operating means, for example of electromechanical type, making it possible to reduce the costs of operation and provide the desired economic performance where the rocket motor is concerned.

As soon as combustion of the solid charge of the gas generator has been initiated, pressurized gas is transmitted, according to the position of the valve, to one of the nozzles 38*a* or 38*b* or to the load-shedding orifice 37 or to the stabilizing chamber 39.

In order to generate a thrust of sufficiently high intensity, the nozzles 38*a* and 38*b* are advantageously configured to generate a supersonic flow of gas. To achieve that, a bore section of small surface area is adopted at the throat of the nozzle, leading to a pressure in the gas generator that is high enough to prime the throat of the nozzle. Because the load-shedding orifice 37 of a first lateral thruster can be selected at the same time as a nozzle of a second lateral thruster, the surface area of the bore section of the load-shedding orifice needs to be kept identical to that of the nozzles in order to maintain the desired level of pressure in the gas generator.

Configured in this way, the nozzles 38*a* and 38*b* and the load-shedding orifice 37 make it possible according to a first aspect of the present invention to control the trajectory of a missile about these three axes of navigation. By delivering a thrust in a plane substantially perpendicular to the main axis, the device makes it possible to create a couple which alters the trajectory of the missile. The device can be configured to generate high intensity thrusts, allowing trajectory modifications with very small radii of curvature. The moment-steering device according to the invention is therefore particularly well suited to short-range missions for which a high degree of missile agility is required. In addition, the device according to the invention does not have any range of kinetic moment deemed to be limiting, which makes it a device of choice for missile systems that need to incorporate what is well known to those skilled in the art as a "soft vertical launch" profile at the start of the mission.

According to a second aspect of the present invention, the device makes it possible to reduce the coefficient of drag by injecting gas downstream of the base of the missile with a view to reducing the depression generated in the wake of the missile. When the missile is in free flight, namely after the end of combustion of the solid charge of the main rocket motor, aerodynamic disturbances behind the missile, downstream of the base, generate a depression and slow the missile. This being so, the device is called upon to reduce this depression by using the stabilizing chamber 39 to inject gas downstream of the base. By improving the range of the missile, the device is particularly suited to long-range missions.

For preference, the stabilizing chambers 39 of each of the lateral thrusters communicate freely with one another. In the embodiment depicted in FIG. 3, the device comprises a stabilizing chamber that is common to all of the lateral thrusters 20. The directional-control devices 36 of each of the lateral thrusters transmit the pressurized gas toward this common stabilizing chamber.

In FIG. 3, a stabilizing chamber 39 common to each of the lateral thrusters, axisymmetric in shape, is produced using two axisymmetric partitions 40 and 41 fixed to the support 34. These axisymmetric partitions have high thermal resistance in order to be able to withstand the solid charge combustion gases and thus protect, on the one hand, the lateral thrusters and, on the other hand, the central main rocket motor. Advantageously, additional thermal protection 42 may be arranged on a surface of the divergent nozzle that is exposed to the combustion gases of the solid charge of the gas generator. An outlet section 43 of annular shape is formed between the divergent nozzle and the base restriction 33. After being expanded in the stabilizing chamber, the gases are expelled through this outlet section 43 substantially perpendicular to the main axis 11, thus contributing to lessening the depression downstream of the base. What is meant by substantially perpendicular to the main axis 11 is any axis making an angle of less than 10° with the axis strictly perpendicular to the main axis 11.

Unlike the lateral nozzles 38*a* and 38*b* and the load-shedding orifice 37, the bore section of the stabilizing chamber 39 has a relatively large surface area making it possible to slow the combustion of the solid charge. Advantageously, the stabilizing chamber is configured to generate a subsonic flow of gas.

FIG. 4 depicts one embodiment of a plug valve used in the combined device depicted in FIG. 3. Advantageously, the plug valve 50 has, for the two lateral nozzles 38*a* and 38*b* and the load-shedding orifice, a constant bore section. The valve does not have a closed position between these three positions; it is open whatever the position of the plug, with a view to avoiding any uncontrolled overpressure in the event of valve failure. The valve is controlled by an electronic module according to a position instruction chosen from four possible valve positions.

Figure 5:
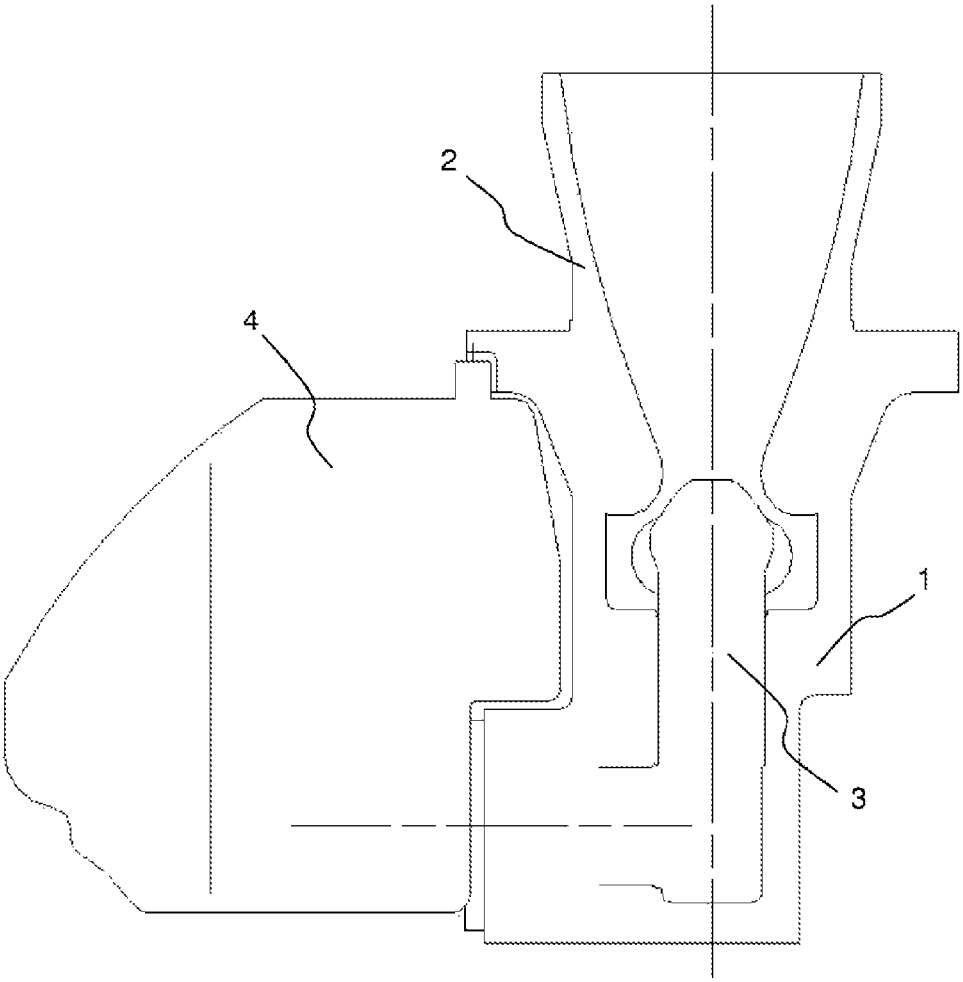
FIG. 5 depicts one embodiment of a multi-way valve of the needle valve type used in the combined device depicted in FIG. 3.

FIG. 5 depicts one embodiment of a needle valve used in the combined device depicted in FIG. 3. The needle valve comprises the following components:

a valve body 1, preferably monolithic, providing the thermostructural integrity of the valve (reacting internal pressure loadings and thermomechanical loadings), transporting gas from the combustion chamber (from one or more inlet ducts) and providing an interface with the other components (nozzle, needle and actuator), a nozzle 2 fixed to the valve body 1, preferably monolithic, comprising a convergent part, a throat and a divergent part for accelerating the gases and generating a thrust force, a needle 3 moved translationally along the axis of the nozzle, and with the throat of the nozzle generating a variable annular sonic section allowing control of the thrust, flow rate and operating pressure of the motor, an alternative technology being to rotate a plug past the throat of a two-dimensional or spherical nozzle, an activation device 4 for moving the needle and for which there are two activation solutions contemplated:

- activation of the electropneumatic on/off type with a free needle: the needle is held in the open or closed position by a pilot stage controlling the equilibrium of pressures between the front and the rear of the free needle. Use of a second pilot stage or of PWM (Pulse Width Modulation) control also allows intermediate needle positions to be provided.
- electromechanical proportional activation with direct action on the needle: the position of the needle can be modified continuously by an electric motor and a motion transducer device (needle/electric motor transmission).

The use of composite thermostructural materials and of hot sealing devices is encouraged in order to allow high temperature operation for lengthy periods of time and minimize inert masses.

Heat shields may also be arranged on the remaining metallic components according to the temperature of the gases and the operating durations.

The orientation and number of valves can be adapted according to the functional requirements of the system (maneuvering couples, ability to cancel the load patterns, modulation of motor pressure, etc.) and constraints pertaining to size vs space.

The valves may preferably be supplied by a gas generator in common or may be supplied individually by separate gas generators.

Simultaneous control of the valves advantageously makes it possible:

to regulate the operating pressure of the motor by adjusting the opening of the needle valves notably according to the ballistic properties of the propellant, the change in combustion area of the charge, differential thermal expansions of needle/nozzle throat, manufacturing spread.

to modulate the operating pressure of the motor according to the system requirements (intensity of maneuvers during the boost or cruising flight phases) and according to a logic for optimizing the propellant consumption; in particular, simultaneous opening of opposite nozzles makes it possible to reduce the combustion pressure and therefore the motor flow rate without generating a resulting couple or force (canceling the load pattern)

to optimize and safeguard operation of the motor during transient changes in pressure such as ignition (reducing the time taken to get up to speed) and transient phases in the transition between boost and cruising flight, to improve the performance of the motor by compensating for the usual drifts in pressure (variations in the rate of combustion of the propellant as a function of operating temperature, expansion of throat components, manufacturing spread, effects of thermal losses, etc.).

It is also contemplated to use a multi-way valve of the needle valve type. It is even contemplated to use several independent single-way valves. Let us note that the combined device and the missile which are depicted in the figures constitute one nonlimiting embodiment of the invention. It is the widespread scenario of a missile comprising a cylindrical body and a control system comprising four wings that has been depicted in particular. A combined device comprising four lateral thrusters which are arranged on the base of the missile in the continuation of the wings has therefore been depicted. Lateral thrusters comprising two nozzles the respective thrusts of which are oriented along an axis perpendicular to an axis contained in said plane and passing through the main axis of navigation, and in a direction away from one another have therefore been depicted.

This configuration is not intended to place a restriction on the present invention which relates more broadly to a combined steering and drag reduction device intended for a missile comprising a base and an upper part which are arranged in succession along a main axis of navigation of the missile. The device comprises a pressurized-gas generator and at least one lateral thruster comprising:

at least one nozzle, configured to deliver a thrust, by expanding gas transmitted by the generator and oriented along an axis substantially perpendicular to the main axis of navigation, at least one stabilizing chamber configured to expand the gas transmitted by the generator and expel it through an outlet section of the base substantially perpendicular to the main axis of navigation.

At least one lateral thruster comprises a directional-control device that makes it possible to select a nozzle or a stabilizing chamber of the lateral thruster and transmit pressurized gas from the generator toward the selected nozzle or the selected stabilizing chamber.

Advantageously, the device comprises several lateral thrusters and a control module configured to control the directional-control devices of each of the lateral thrusters according to a control instruction.

Finally, the invention also relates to a missile comprising a combined control and drag reduction device having the features described hereinabove.

The invention claimed is:

1. A combined steering and drag reduction device for a missile comprising a base and an upper part which are arranged in succession along a main axis of navigation of the missile, the device comprising:

a pressurized-gas generator and at least one lateral thruster comprising:

at least one nozzle configured to deliver a thrust, by expanding gas transmitted by the generator and oriented along an axis substantially perpendicular to the main axis, at least one stabilizing chamber configured to expand the gas transmitted by the generator and expel it through an outlet section of the base substantially perpendicular to the main axis.

2. The device of claim 1, wherein the at least one lateral thruster comprises a directional-control device allowing selection of a nozzle or a stabilizing chamber of the lateral thruster and allowing pressurized gas from the generator to be transmitted toward the selected nozzle or the selected stabilizing chamber.

3. The device of claim 2, wherein the directional-control device comprises a multi-way valve of the plug valve type.

4. The device of claim 2, wherein the directional-control device comprises a single-way or multi-way valve of the needle valve type.

5. The device of claim 2, wherein the directional-control device comprises electromechanical or electropneumatic operating means.

6. The device of claim 2, further comprising several lateral thrusters and a control module configured to control the directional-control devices of each of the several lateral thrusters according to a control instruction.

7. The device of claim 1, wherein the pressurized-gas generator comprises a charge and an ignition device, the charge allowing the pressurized gas to be generated by combustion initiated by the ignition device.

8. The device of claim 7, of which the charge consists of a solid propellant, or of a liquid propellant or of a propellant in gel form.

9. The device of claim 7, wherein the pressurized-gas generator is configured to allow control of the repeated ignition and extinguishing of the combustion of the charge.

10. The device of claim 1, wherein the at least one nozzle of at least one lateral thruster is configured to generate a supersonic flow of gas.

11. The device of claim 1, wherein the at least one stabilizing chamber of at least one lateral thruster is configured to generate a subsonic flow of gas.

12. The device of claim 1, further comprising several lateral thrusters, wherein stabilizing chambers of the several lateral thrusters communicate freely with one another and are configured to expel gas through an outlet section substantially perpendicular to the main axis.

13. The device of claim 1, further comprising:

four lateral thrusters arranged on the base of the missile at the four respective corners of a square contained in a plane substantially perpendicular to the main axis and centered on the main axis;

each of the four lateral thrusters comprising two nozzles, the respective thrusts of which are oriented along an axis perpendicular to an axis contained in said plane and passing through the main axis and in a direction away from one another; and the device being configured to control the trajectory of the missile in three directions in space.

14. The device of claim 1, further comprising removable fixing means for fixing the device to the base of the missile.

15. A missile comprising a combined steering and drag reduction device comprising a base and an upper part which are arranged in succession along a main axis of navigation of the missile, the device comprising:

a pressurized-gas generator and at least one lateral thruster comprising:

at least one nozzle configured to deliver a thrust, by expanding gas transmitted by the generator and oriented along an axis substantially perpendicular to the main axis, at least one stabilizing chamber configured to expand the gas transmitted by the generator and expel it through an outlet section of the base substantially perpendicular to the main axis.

* * * * *